US011457756B2

(12) United States Patent
Kulkarni

(10) Patent No.: US 11,457,756 B2
(45) Date of Patent: Oct. 4, 2022

(54) SPILL PROOF BEVERAGE PACKAGING

(71) Applicant: FUINSO Innotech Private Limited, Thane-West (IN)

(72) Inventor: Rajendra Yashwant Kulkarni, Maharashtra (IN)

(73) Assignee: Fuinso Innotech Private Limited

( * ) Notice: Subject to any disclaimer, the term of this patent is extended or adjusted under 35 U.S.C. 154(b) by 363 days.

(21) Appl. No.: 16/728,697

(22) Filed: Dec. 27, 2019

(65) Prior Publication Data

US 2020/0288894 A1 Sep. 17, 2020

(30) Foreign Application Priority Data

Mar. 14, 2019 (IN) ..... 201921009990

(51) Int. Cl.

| | |
|---|---|
| ***A47G 21/18*** | (2006.01) |
| ***B65D 77/28*** | (2006.01) |
| ***B65D 85/72*** | (2006.01) |
| ***A47G 19/22*** | (2006.01) |

(52) U.S. Cl.

CPC ..... *A47G 21/18* (2013.01); *A47G 19/2266* (2013.01); *B65D 77/28* (2013.01); *B65D 77/283* (2013.01); *B65D 85/72* (2013.01)

(58) Field of Classification Search

CPC .... A47G 21/18; A47G 21/182; A47G 21/189; A47G 19/2266; B65D 77/28; B65D 77/283

USPC ..... 206/229, 706, 707, 708, 709, 710; 239/33; 446/202

See application file for complete search history.

(56) References Cited

U.S. PATENT DOCUMENTS

| | | | | |
|---|---|---|---|---|
| 5,160,087 | A * | 11/1992 | Mandell | A47G 21/182 446/202 |
| 2012/0181348 | A1 | 7/2012 | Koehler | |
| 2015/0305528 | A1 * | 10/2015 | Chen | A47G 19/2266 220/666 |

FOREIGN PATENT DOCUMENTS

| | | | |
|---|---|---|---|
| CN | 201920388 | U | 8/2011 |
| CN | 208065005 | U | 11/2018 |
| WO | 2016016237 | A1 | 2/2016 |

* cited by examiner

*Primary Examiner* — King M Chu

(74) *Attorney, Agent, or Firm* — Jason C. Cameron

(57) ABSTRACT

A hollow drinking straw is disclosed. The hollow drinking straw comprises at least three ends. The at least three ends comprises a first end, a second end and a third end. The first end and the second end are configured to intake fluid from a beverage package via the third end. The third end is immersed in the fluid of a beverage package. The hollow drinking straw also comprises at least one nozzle plug, configured to plug in at least one of the first end and the second end of the straw to enable fluid movement during fluid intake process via one of the first end and the second end. Additionally, a hollow straw is retrofitted in a beverage packaging to provide spill proof packaging. The beverage packaging comprising a hollow straw with at least three ends enables easy movement, while traveling or any rough use.

7 Claims, 6 Drawing Sheets

SPILL PROOF BEVERAGE PACKAGING

CROSS-REFERENCE TO RELATED APPLICATION

This application claims the benefit of Complete Patent Application bearing Application No. 201921009990, titled "SPILL PROOF BEVERAGE PACKAGING" filed on Mar. 14, 2019 in India.

FIELD OF INVENTION

Embodiments of a present disclosure relates to sipping means, and more particularly to a drinking straw.

BACKGROUND

Spillage of fluids while drinking from a beverage package is a day to day problem. Usage of two-end hollow straw surely reduces amount of spillage. In contrast, using of the two-end hollow straw provides little protection when overturned during usage. Further, to stop spillage, most of beverage packages are provided with a cover lid. The covering lid must be removed while drinking, and again fitted back with the beverage package during movement or usage. Proper protection is needed from spillage if also the user forgets to cover the beverage container.

In conventional approach, use of a two-end straw has become an indispensable part of every day's life. Here, a drinking straw having a tubular body and opening at one end, reduces or eliminates the need to purse one's lips while drinking through a package. During rough usage, spillage of fluids is a problem. More efficient way to stop spillage of fluid, would be to retrofit the drinking straw inside a beverage package. Another effective way would be to stop the spillage from the drinking straw by any mechanical stoppage.

Hence, there is a need for an improved drinking straw along a beverage packaging to address aforementioned issues.

BRIEF DESCRIPTION

In accordance with one embodiment of the disclosure, a hollow drinking straw is provided. The hollow drinking straw comprises at least three ends. The at least three ends comprises a first end, a second end and a third end. The first end and the second end are configured to intake fluid from a beverage package via the third end. Here, the third end is immersed in the fluid of a beverage package. The hollow drinking straw also comprises at least one nozzle plug. The nozzle plug is configured to plug in at least one of the first end and the second end of the straw to enable fluid movement during fluid intake process via one of the first end and the second end.

In accordance with another embodiment of the disclosure, a beverage packaging is provided. The beverage packaging comprises a hollow straw. The hollow straw comprises at least three ends. The at least three ends comprises a first end, a second end and a third end. The first end and the second end are configured to intake the fluid from the beverage packaging via the third end. Here, the third end is immersed in the fluid of the beverage packaging. The beverage packaging also comprises at least one nozzle plug. The at least one nozzle plug is configured to plug in at least one of the first end and the second end of the hollow straw to enable fluid movement during fluid intake process via one of the first end and the second end.

To further clarify the advantages and features of the present disclosure, a more particular description of the disclosure will follow by reference to specific embodiments thereof, which are illustrated in the appended figures. It is to be appreciated that these figures depict only typical embodiments of the disclosure and are therefore not to be considered limiting in scope. The disclosure will be described and explained with additional specificity and detail with the appended figures.

BRIEF DESCRIPTION OF THE DRAWINGS

The disclosure will be described and explained with additional specificity and detail with the accompanying figures in which.

Figure 1:
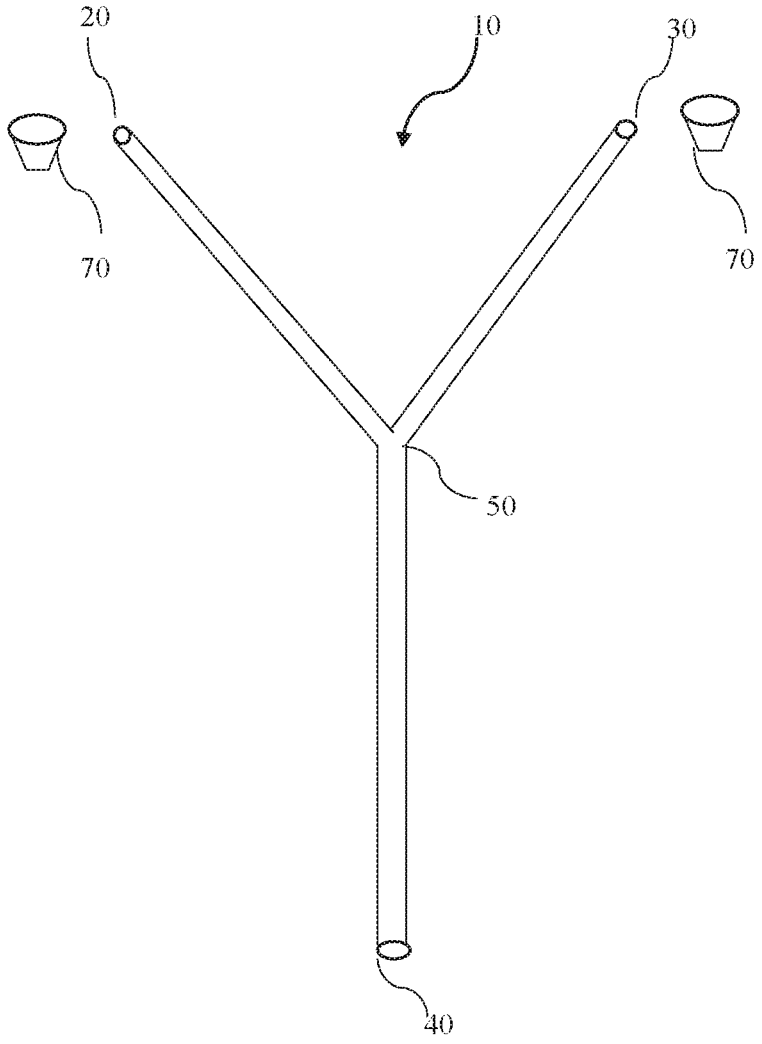
FIG. 1 is a diagrammatic representation of an embodiment representing a Y-shaped hollow drinking straw in accordance with an embodiment of the present disclosure.

Further, those skilled in the art will appreciate that elements in the figures are illustrated for simplicity and may not have necessarily been drawn to scale. Furthermore, in terms of the construction of the device, one or more components of the device may have been represented in the figures by conventional symbols, and the figures may show only those specific details that are pertinent to understanding the embodiments of the present disclosure so as not to obscure the figures with details that will be readily apparent to those skilled in the art having the benefit of the description herein.

DETAILED DESCRIPTION

For the purpose of promoting an understanding of the principles of the disclosure, reference will now be made to the embodiment illustrated in the figures and specific language will be used to describe them. It will nevertheless be understood that no limitation of the scope of the disclosure is thereby intended. Such alterations and further modifications in the illustrated online platform, and such further applications of the principles of the disclosure as would normally occur to those skilled in the art are to be construed as being within the scope of the present disclosure.

The terms "comprises", "comprising", or any other variations thereof, are intended to cover a non-exclusive inclusion, such that a process or method that comprises a list of steps does not include only those steps but may include other steps not expressly listed or inherent to such a process or method. Similarly, one or more devices or sub-systems or elements or structures or components preceded by "comprises . . . a" does not, without more constraints, preclude the existence of other devices, sub-systems, elements, structures, components, additional devices, additional sub-systems, additional elements, additional structures or additional components. Appearances of the phrase "in an embodiment", "in another embodiment" and similar language throughout this specification may, but not necessarily do, all refer to the same embodiment.

Unless otherwise defined, all technical and scientific terms used herein have the same meaning as commonly understood by those skilled in the art to which this disclosure belongs. The system, methods, and examples provided herein are only illustrative and not intended to be limiting.

In the following specification and the claims, reference will be made to a number of terms, which shall be defined to have the following meanings. The singular forms "a", "an", and "the" include plural references unless the context clearly dictates otherwise.

Embodiments of the present invention relates to a hollow drinking straw. The hollow drinking straw comprises at least three ends. The at least three ends comprises a first end, a second end and a third end. The first end and the second end are configured to intake fluid from a beverage package via the third end. Here, the third end is immersed in the fluid of a beverage package. The hollow drinking straw also comprises at least one nozzle plug. The nozzle plug is configured to plug in at least one of the first end and the second end of the straw to enable fluid movement during fluid intake process via one of the first end and the second end.

Embodiments of the present invention relates to a beverage packaging is provided. The beverage packaging comprises a hollow straw. The hollow straw comprises at least three ends. The at least three ends comprises a first end, a second end and a third end. The first end and the second end are configured to intake the fluid from the beverage packaging via the third end. Here, the third end is immersed in the fluid of the beverage packaging. The beverage packaging also comprises at least one nozzle plug. The at least one nozzle plug is configured to plug in at least one of the first end and the second end of the hollow straw to enable fluid movement during fluid intake process via one of the first end and the second end.

Figure 2:
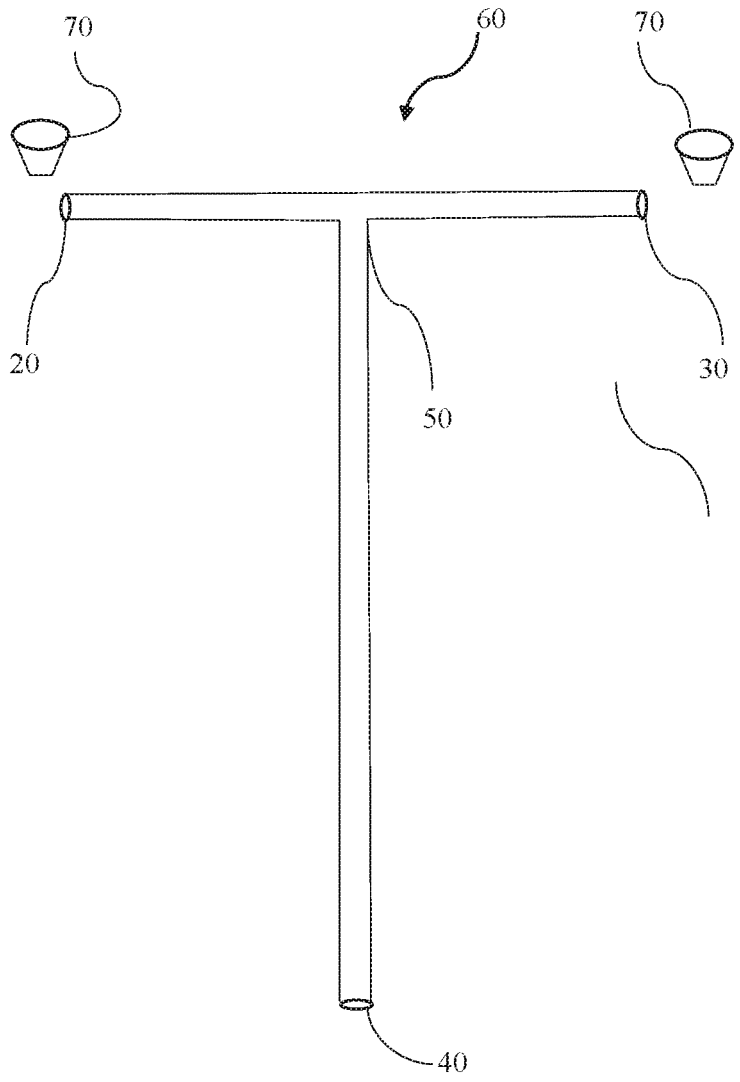
FIG. 2 is a diagrammatic representation of an embodiment representing a T-shaped hollow drinking straw in accordance with an embodiment of the present disclosure.
Figure 3:
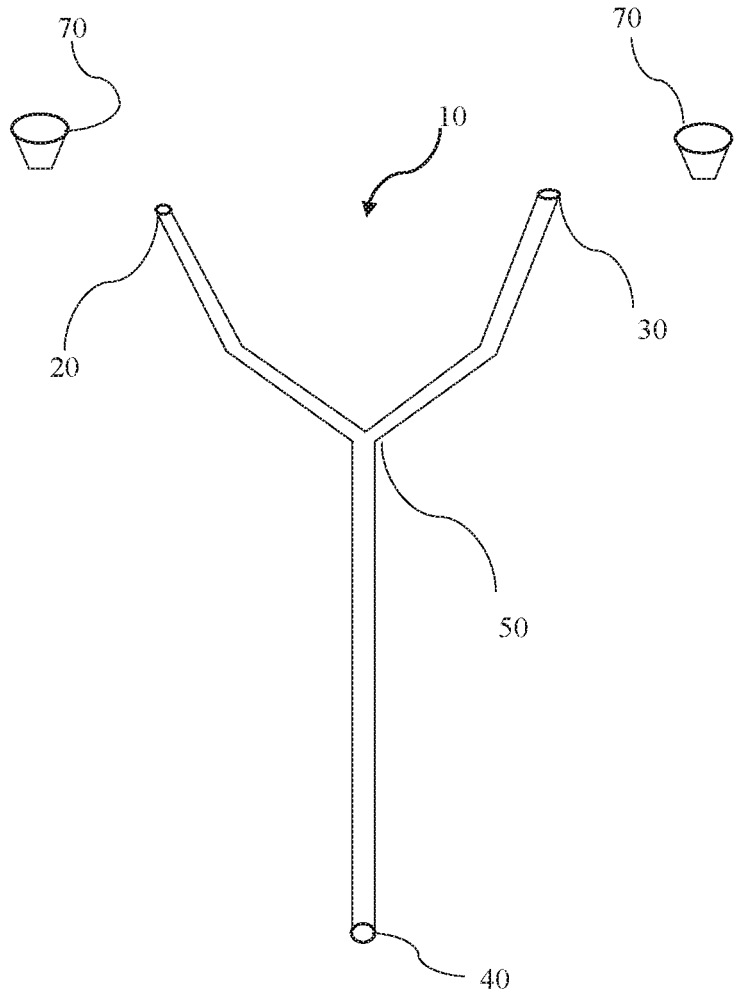
FIG. 3 is a diagrammatic representation of an embodiment representing an exemplary Y-shaped hollow drinking straw of FIG. 1 in accordance with an embodiment of the present disclosure.

FIG. 1 is a diagrammatic representation of an embodiment representing a Y-shaped hollow drinking straw 10 in accordance with an embodiment of the present disclosure. As used herein, term "drinking straw" refers to a long thin hollow paper or plastic tube, used for sucking up liquids into the mouth. In one embodiment, the drinking hollow straw may be of T-shaped 60 (as shown in FIG. 2), In another embodiment, the drinking hollow straw may be of an exemplary Y-shaped 10 (as shown in FIG. 3).

The hollow drinking straw 10 comprises at least three ends. In one embodiment, the at least three ends comprises of a first end 20, a second end 30 and a third end 40. In such embodiment, the first end 20 and the second end 30 are configured to intake fluid via the third end 40.

In another such embodiment, the third end 40 is immersed in the fluid. In another embodiment, the hollow drinking straw may be made of plastic material. In such embodiment, the hollow drinking straw is fabricated in shape of at least one of a Y-shaped straw 10 and a T-shaped straw 60.

In one embodiment, the liquid may be filled in a beverage package, whereby a beverage package refers to a package or containers. In such embodiment, the beverage package may be fabricated by at least one of cartoon, plastic, polymer and the like.

The hollow drinking straw 10 also comprises at least one nozzle plug 70. In one embodiment, the at least one nozzle plug 70 is configured to plug in at least one of the first end 20 and the second end 30 of the straw to enable fluid movement during fluid intake process via one of the first end 20 and the second end 30. Here, in another embodiment, the at least one nozzle plug may be at least one thumb, finger and the like.

Furthermore, in one embodiment, the hollow drinking straw 10 comprising at least three ends fabricated in shape of at least one of a Y-shaped straw 10 and a T-shaped straw 60.

In one exemplary embodiment, a user while intaking fluid from the first end 20, may plug the second end 30 with the nozzle plug 70. In such exemplary embodiment, the air pressure modified by the user upon suction of the fluid inside the Y-shaped straw 10 pushes the liquid out of the first end 20. In one such embodiment, normal process of intake of fluid is enabled, whereby the nozzle plug acts as an enabler.

In another exemplary embodiment, the liquid movement will automatically stop, if the nozzle plug 70 is not present. Here, in such exemplary embodiment, Y-shaped straw 10 enables no spilling of liquid during no use condition as liquid is not permitted to move above the meeting point of the first end and the second end 50.

Furthermore, in another such embodiment, the spillage of fluid reduces further when the user is travelling with a beverage package containing the hollow straw 10, 60 or using the beverage package containing the hollow straw 10, 60 in any fashion. In such embodiment, during rough usage or travelling usage by the user, the fluid movement is stopped at the meeting point of the first end and the second end 50.

Figure 4:
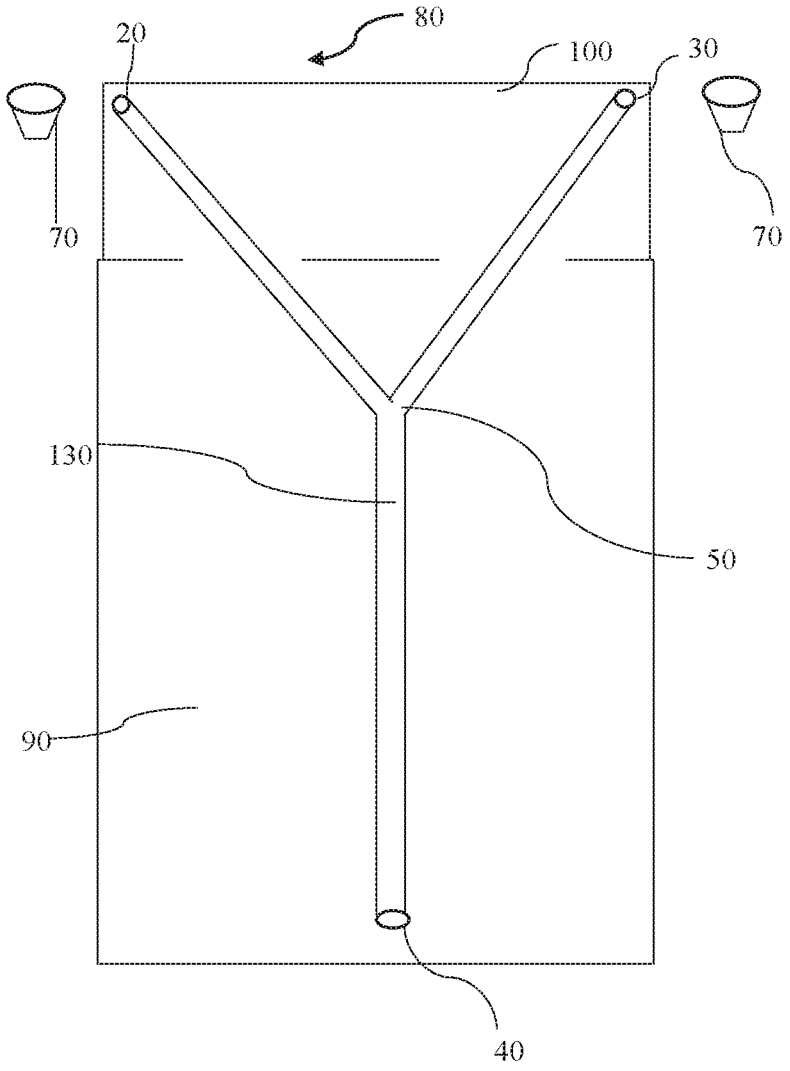
FIG. 4 is a diagrammatic representation of another embodiment representing a beverage packaging with a Y-shaped hollow drinking straw of FIG. 1 in accordance with an embodiment of the present disclosure.
Figure 5:
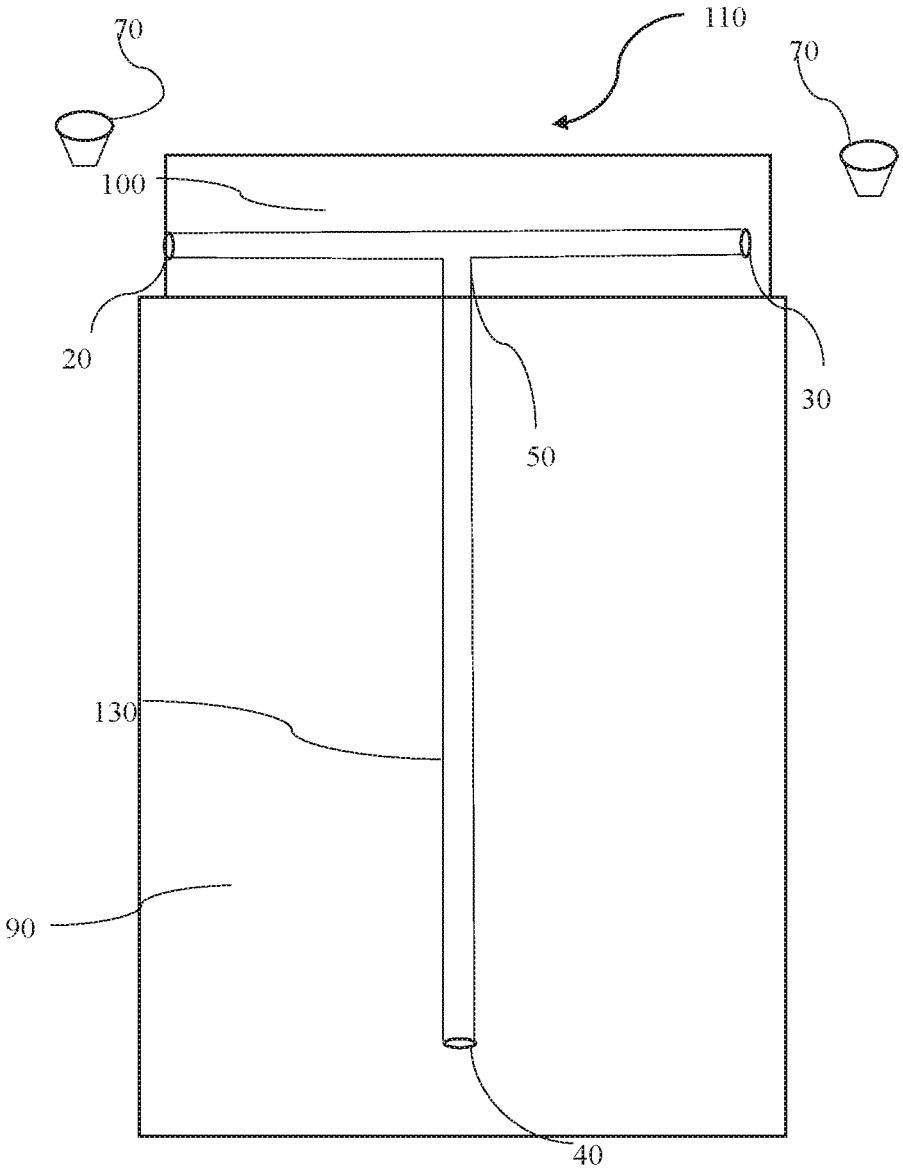
FIG. 5 is a diagrammatic representation of an embodiment representing a beverage packaging with a T-shaped hollow drinking straw of FIG. 2 in accordance with an embodiment of the present disclosure.

FIG. 4 is a diagrammatic representation of an embodiment representing a beverage packaging with a Y-shaped hollow drinking straw 80 in accordance with an embodiment of the present disclosure. In one embodiment, beverage packaging refers to package that provides protection, tampering resistance, and special physical, Chemical, or biological needs. In another embodiment, the beverage packaging is provided with a T-shaped hollow drinking straw 110 as shown in FIG. 5.

The beverage packaging 80 comprises a hollow straw 130 comprising at least three ends. In one embodiment, the at least three ends comprises a first end 20, a second end 30 and a third end 40. In such embodiment, the first end 20 and the second end 30 are configured to intake the fluid from the beverage packaging 90 via the third end 40. In another such embodiment, the third end 40 is immersed in the fluid of the beverage packaging 90.

Figure 6:
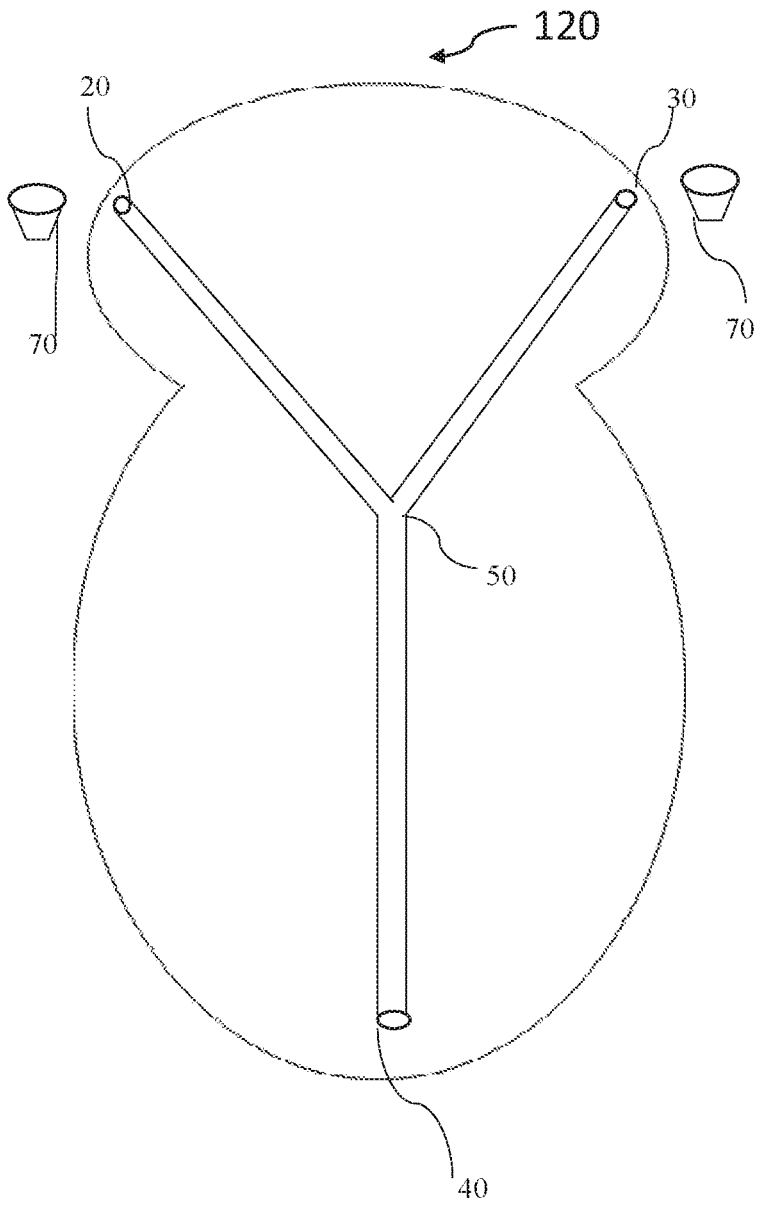
FIG. 6 is a diagrammatic representation of an embodiment representing an exemplary beverage packaging in accordance with an embodiment of the present disclosure.

In one embodiment, the beverage packaging 90 is configured in a shape comprising at least one of circular, triangular, cuboidal and cylindrical. Moreover, in one embodiment, the hollow straw comprising the at least three ends are fabricated in shape of at least one of a Y-shaped straw 80 and a T-shaped straw 110. FIG. 6 is a diagrammatic representation of an embodiment representing an exemplary beverage packaging in accordance with an embodiment of the present disclosure.

The beverage packaging 90 also comprises the at least one nozzle plug 70. In one embodiment, the beverage packaging 90 is configured to plug in at least one of the first end 20 and the second end 30 of the hollow straw 130 to enable fluid movement during fluid intake process via one of the first end 20 and the second end 30. In one such embodiment, normal process of intake of fluid from the beverage packaging 90 is enabled, whereby the nozzle plug 70 acts as an enabler. Here, in another embodiment, the at least one nozzle plug 90 may be at least one thumb, finger and the like.

In another embodiment, during no use condition, liquid in the beverage packaging 90 is not permitted to move above the meeting point of the first end and the second end 50 as the shape of the Y-shape straw and T-shape straw prohibits.

The beverage packaging 90 also comprises a lid cover 100 mechanically coupled with the beverage packaging 90. In one embodiment, the lid cover is configured to seal the hollow straw 130 within the beverage packaging 90. In such embodiment, shapes of the lid cover 100 comprises at least one of circular, triangular, cuboidal and cylindrical.

In another such embodiment, the lid cover 100 shape is associated with the shape of the beverage packaging 90. In an exemplary embodiment, after usage the first end 20 and the second end 30 may plugged. In such exemplary embodiment, further protection is provided by covering the retrofitted hollow straw 130 part by a lid cover 100.

Present disclosure of a hollow drinking straw provides a spill proof mechanism of drinking. Further, a beverage packaging comprising the hollow drinking straw which enables easy movement, while traveling or any rough use. A lid cover further gives protection from spillage. In situation when the beverage package is knocked over, the lid cover provides protection from spillage.

The nozzle plug in all together act as an enabler during intake of fluid. Present disclosure of a beverage packaging with a hollow straw with three ends is easy for children to open, without requiring parental supervision.

While specific language has been used to describe the disclosure, any arising on account of the same are not intended. As would be apparent to a person skilled in the art, various working modifications may be made to the method in order to implement the inventive concept as taught herein.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, order of processes described herein may be changed and are not limited to the manner described herein. Moreover, the actions of any flow diagram need not be implemented in the order shown; nor do all of the acts need to be necessarily performed. Also, those acts that are not dependent on other acts may be performed in parallel with the other acts. The scope of embodiments is by no means limited by these specific examples.

I claim:

1. A hollow drinking straw, consisting of:

at least three ends, wherein the at least three ends consists of a first end, a second end and a third end;

wherein the first end and the second end are configured to intake fluid via the third end, wherein the third end is immersed in the fluid; and at least one nozzle plug is configured to plug inside at least one of the first end and the second end of the hollow straw to enable fluid movement during fluid intake process via one of the first end and the second end.

2. The hollow drinking straw as claimed in claim 1, wherein the hollow drinking straw consisting of at least three ends is fabricated in a shape of at least one of a Y-shaped hollow straw and a T-shaped hollow straw.

3. A beverage packaging, consisting of:

a hollow straw consisting of at least three ends, wherein the at least three ends consists of a first end, a second end and a third end;

wherein the first end and the second end are configured to intake the fluid from the beverage packaging via the third end, wherein the third end is immersed in the fluid of the beverage packaging, wherein, the beverage packaging consists of a beverage tetrahedron-shaped plastic-coated paper carton; and at least one nozzle plug, and configured to plug inside at least one of the first end and the second end of the hollow straw to enable fluid movement during fluid intake process via one of the first end and the second end.

4. The beverage packaging as claimed in claim 3, wherein the hollow straw consisting of the at least three ends is fabricated in shape of at least one of a Y-shaped straw 80 and a T-shaped straw.

5. The beverage packaging as claimed in claim 3, wherein a shape of the beverage packaging consists of at least one of circular, triangular, cuboidal and cylindrical.

6. The beverage packaging as claimed in claim 3, consisting of a lid cover mechanically coupled with the beverage packaging, and configured to seal the hollow straw within the beverage packaging.

7. The beverage packaging as claimed in claim 6, wherein shapes of the lid cover consists of at least one of circular, triangular, cuboidal and cylindrical, wherein the lid cover shape is associated with the shape of the beverage packaging.

* * * * *